United States Patent [19]

Braun

[11] 4,166,231

[45] Aug. 28, 1979

[54] TRANSVERSE BEAM X-RAY TUBE

[75] Inventor: Martin Braun, San Jose, Calif.

[73] Assignee: The Machlett Laboratories, Inc., Stamford, Conn.

[21] Appl. No.: 840,205

[22] Filed: Oct. 7, 1977

[51] Int. Cl.[2] ..... H01J 35/04; H01J 35/14

[52] U.S. Cl. ..... 313/60; 250/505

[58] Field of Search ..... 313/60, 55, 57, 59; 250/505, 511, 512, 513

[56] References Cited

U.S. PATENT DOCUMENTS

| | | | |
|---|---|---|---|
| 805,795 | 11/1905 | Heinze | 313/59 |
| 1,714,975 | 5/1929 | Coolidge | 313/59 X |
| 3,113,233 | 12/1963 | Kasten et al. | 313/60 |
| 3,942,015 | 3/1976 | Huxley | 313/60 X |

*Primary Examiner*—Rudolph V. Rolinec
*Assistant Examiner*—Darwin R. Hostetter
*Attorney, Agent, or Firm*—Harold A. Murphy; Joseph D. Pannone; John T. Meaney

[57] ABSTRACT

An X-ray generator which produces a beam of parallel substantially non-spreading radiation, the generator including a housing containing a tube having an envelope containing an X-ray generating target and an X-ray transmissive window, the target having a focal spot from which the useful X-rays are emitted which is located at the side of the tube remote from the window, and aperture means in the path of the beam either within the envelope or adjacent the housing for collimating the beam and shaping it to the desired cross-sectional configuration and for restricting beam divergence.

11 Claims, 5 Drawing Figures

TRANSVERSE BEAM X-RAY TUBE

BACKGROUND OF THE INVENTION

In X-ray tubes of conventional constructions it has been common practice to dispose a substantially round exit window of the tube as close as possible to the focal spot on the target where X-radiation is generated. This enables the tube to emit through the window a conical beam which, because of its proximity to the focal spot, increases greatly in cross-sectional size as it passes in a direction away from the tube. This enables the tube to irradiate a relatively broad or expansive area, the eventual shape and size of which may be controlled by passing the beam through a suitable collimator which intercepts marginal portions of the beam so that the radiation will be controllably confined to a predetermined area.

In some tubes used for specific purposes it is desirable to produce a beam having a fan shape. This is achieved by providing the exit window with an elongated rectangular configuration. A tube having such a window is shown and described in U.S. Pat. application Ser. No. 719,026, which is owned by the assignee of the present invention. However, while the X-ray beam in such tubes is substantially fan-shaped, it still has some undesired divergence in the shorter direction of the window since the focal spot from which the X-rays are emitted is considerably smaller than the size of the window opening.

In computerized axial tomography, for example, it is highly desirable that an X-ray beam be emitted which produces at the desired image plane a radiation pattern which is long and narrow in shape, the narrow dimension being desired so that at any one time a single linear array or row of detectors may be irradiated while adjacent parallel rows on either side of the first row will not be contacted by the beam. It will be apparent that if much divergence in the X-ray beam exists, the adjacent rows of detectors may be undesirably irradiated.

It has also been found that scattered radiation from other internal parts of the tube sometimes escapes and contributes undesirably to the irradiation of the detector system.

SUMMARY OF THE INVENTION

It is one of the primary objectives of this invention to overcome the above and other objections to known X-ray tubes by providing means whereby a parallel relatively non-spreading X-ray beam is produced. This reduces patient dosage and allows a more precisely formed cylindrical or fan-shaped beam to be emitted which will be confined to an irradiation area suitable for tomographic systems.

This is achieved in accordance with this invention by the provision of collimating means within and/or external of the tube envelope and, further, by locating the focal spot in the tube at a point on the remote side of the tube diametrically opposite the exit window. In such a tube structure the beam will pass a long distance across the tube before it reaches the exit window. Thus, a parallel substantially non-spreading or non-diverging beam is emitted from the tube.

It has been found that suitable apertures, one or more, may be placed in the path of the X-ray beam within or at the exit window of the tube to collimate the radiation which is directed toward the exit window.

By such a structure as described herein, scattered radiation is prevented from contributing to the useful emitted X-radiation, being substantially entirely absorbed within the tube.

BRIEF DESCRIPTION OF THE DRAWINGS

The above and other objectives of this invention will become apparent from the following description taken in connection with the accompanying drawings, wherein.

DESCRIPTION OF THE PREFERRED EMBODIMENTS

Figure 1:
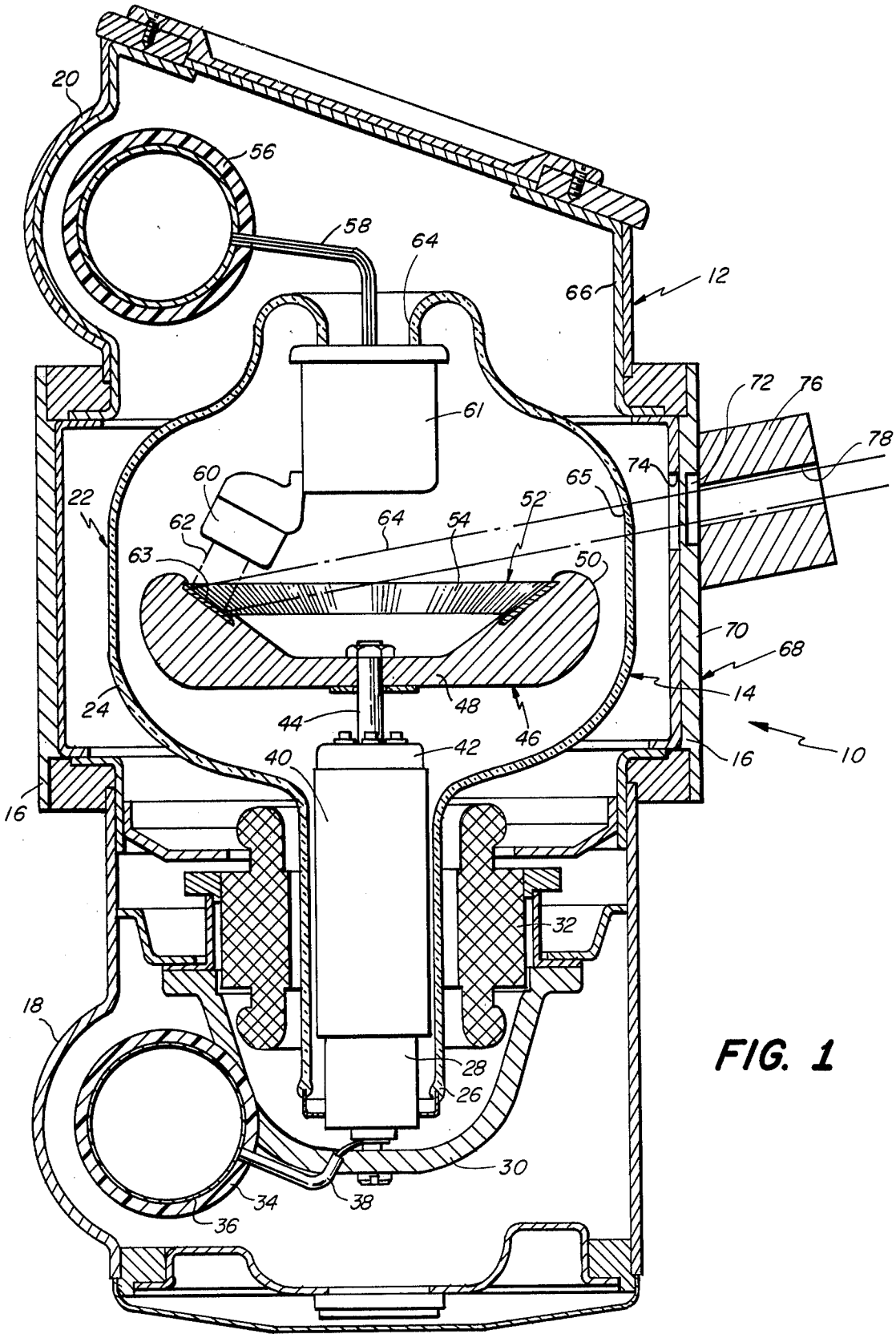
FIG. 1 is an axial sectional view through an X-ray generator embodying the invention.

Referring to the drawings wherein like characters of reference designate like parts throughout the several views, there is shown in FIG. 1 an X-ray generator 10 which includes a housing 12 within which is an X-ray tube 14 of the rotating anode type.

The housing 12 is of any suitable structure but is shown herein as comprising a central substantially cylindrical section 16, an anode end section 18, and a cathode end section 20. The X-ray tube 14 includes an X-ray transparent envelope 22 having a major bulb portion 24 which is enclosed by the central housing section 16 with a narrow neck 26 projecting downwardly into the anode end section 18 and encircling a rotor 28 which projects through the end of the envelope and by which the tube is supported upon a fixed support member 30 suitably carried by the internal wall of the housing section 18.

A stator 32 encircles the envelope neck portion 26 and is also suitably fixed to the housing section 18. A cable receptacle 34 is provided in one side of housing section 18 and includes an anode terminal portion 36 within which an interfitting electrical cable (not shown) is adapted to interfit to carry electrical energy of suitable voltage via wire 38 to the tube.

Mounted over rotor 28 is a skirt 40 at one end of which is carried a nose 42 which suitably supports one end of an axially extending shaft 44 to the other end of which is secured a target 46. The target illustrated in FIG. 1 is a substantially cup-shaped member having a transversely extending base portion 48 and an upstanding thickened peripheral or rim portion 50 having an inclined inner surface or wall as shown. Within or on the inclined inner surface is disposed a track portion 52 which is comprised of a number of radially extending pinlike members 54 in side-by-side relation throughout the annular track 52. Members 54 are made of efficient X-ray generating material such as tungsten, and the target body, particularly rim portion 50, is of good heat-absorbing material such as molybdenum.

It will be apparent that when suitable electrical potential is applied to the anode, the target 46 will be rotated at a selected relatively high speed. An example of a rotating anode X-ray tube of this character is shown and described in U.S. Pat. No. 3,842,305 owned by the assignee of the present invention. For additional details of the X-ray tube shown in FIG. 1, reference may be made to said U.S. Pat. No. 3,842,305.

In the cathode end section 20 of the housing 12 is a second cable receptacle 56 which is adapted to receive and support a cable terminal (not shown) by which cathode filament current may be supplied through wires 58 to the tube 14. The wires 58 are conventionally connected to a cathode filament (not shown) within a cathode 60 as is well known, the cathode being suitably mounted as by support member 61 on a reentrant portion 64 of the envelope 22.

The cathode 60, as is well known, includes the filament (not shown) which is adapted to produce electrons when suitable filament potential is applied from wires 58, such electrons being directed onto the focal track 52 of the rotating anode target 46 along electron beam path 62. The area of the focal track upon which the electron beam impinges is known as the focal spot 63, and X-radiation is produced as a result of such electron bombardment. Such X-radiation is emitted from the focal spot 63 in all directions. However, it is desired that only a portion of such radiation be utilized, this portion being illustrated in FIG. 1 as an X-ray beam 64. This useful X-ray beam 64 passes from the focal spot 63 transversely within the envelope and through an X-ray transmitting window area 65 which may be an unaltered portion of the envelope wall or may be specially formed by thinning this area of the wall or otherwise making it conducive to passage of X rays without detrimental absorption. The unwanted or unused X-radiation is intercepted and absorbed by a lead lining 66 which is provided on the inner walls of the housing 12 so that it will not escape into the atmosphere.

The central section 16 of the housing 10 includes a port structure 68 which includes a plate 70 having an X-ray transmissive window 72 therein which is aligned with an aperture 74 in the lead liner 66 so that the X-ray beam 64 may pass outwardly through the housing wall. The window 72 is mde of beryllium or other good X-ray transmitting material.

It will be apparent that an X-ray beam normally passing through the window 72 will diverge considerably as it progresses outwardly away from the housing. This will be particularly true if the focal spot 63 lies relatively close to the window.

However, in accordance with this invention, the window 72 is disposed in the envelope wall diametrically opposite the focal spot 63 on the target where the X-rays are produced. Thus, the useful X-ray beam 64 must traverse a long path from the focal spot 63, across a major portion of the diameter of the target 46, through the space between the tube and the window 72. While the aperture 74 in the lead lining will perform some degree of collimation, desired final collimation is achieved by a collimator 76 which is mounted over the window 72 on the exterior of the port 68. The collimator 76 is a block of material which is substantially opaque to X-radiation, such as lead or the like, and is provided with a bore 78 therethrough which is aligned with the window 72 and is of a selected size to allow passage through it of an X-ray beam of the desired diameter.

In cases where a pencil beam of X-rays is desired the bore 78 will be cylindrical. Where a fan-shaped beam of X-rays is desired, the bore 78 will be appropriately shaped to be wider in one direction than in the opposite direction. Since the collimator is wide enough so that the bore is of a substantial length, it will be apparent that undesired divergence of the beam will be effectively reduced or eliminated when the beam leaves the device.

Figure 2:
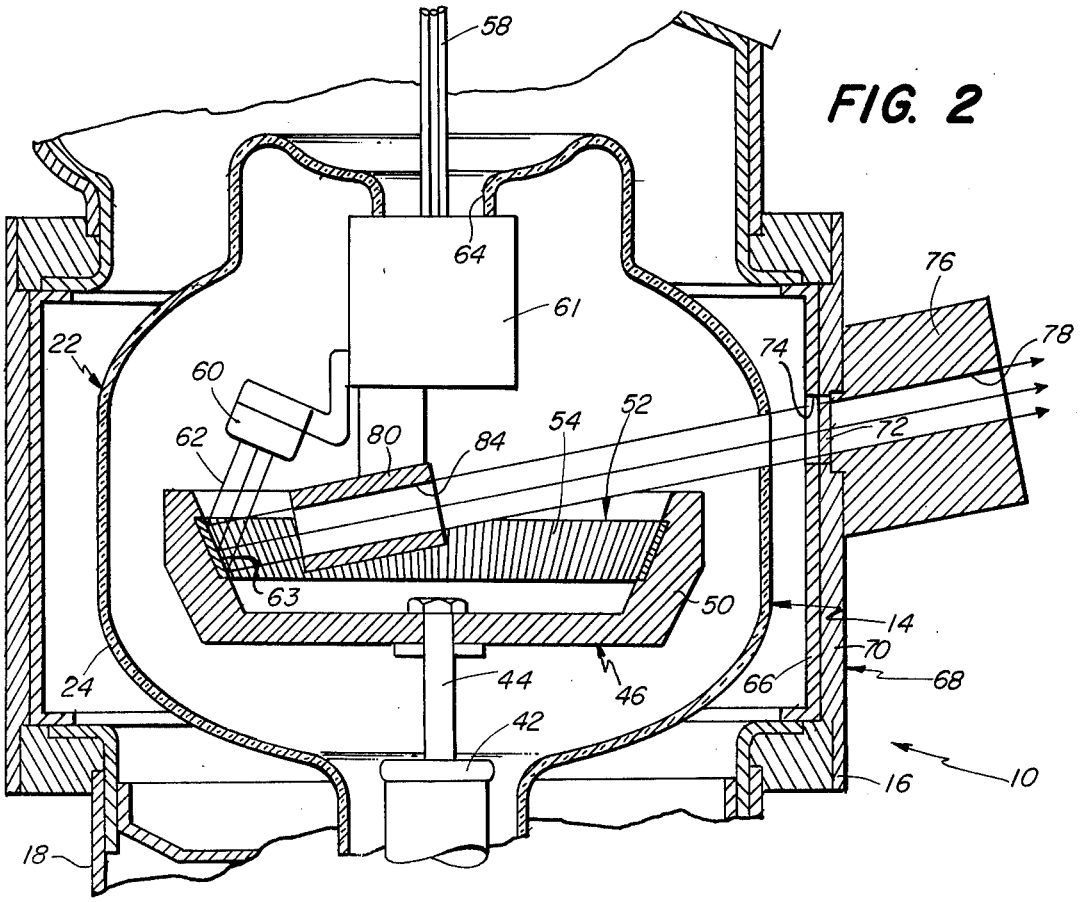
FIG. 2 is a fragmentary sectional view of a portion of the device of FIG. 1 showing a tube with internal collimation.

It has been found that collimation may be achieved if a collimator is placed within the envelope in a position to properly intercept the X-radiation. For example, as shown in FIG. 2, a collimator 80 is mounted on a support 82 and depends therefrom as shown. The useful X-ray beam 64 passes through the bore 84 in the collimator 80 and becomes properly shaped within the tube envelope. With the second collimator 80 located near the focal spot 63 as shown, it is advisable to also utilize the external collimator 76. However, if the inner collimator is located nearer the window 72, the external collimator may be omitted. The most important feature is that the useful X-ray beam 64 travels a substantial distance before final collimation.

The bore 84 in the internal collimator 80 will, of course, be suitably shaped to provide the useful X-ray beam with the desired cross-sectional configuration.

Figure 4:
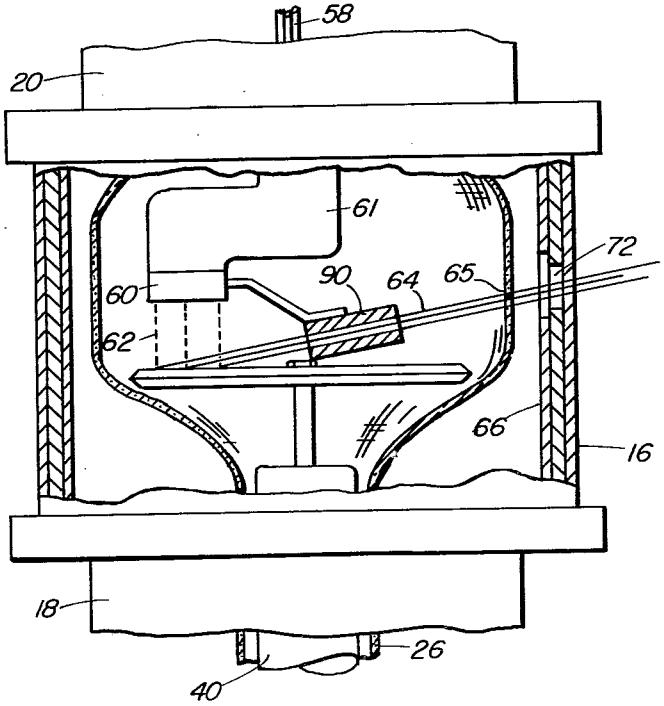
FIG. 4 is a view similar to FIG. 3 showing the tube with internal collimation.
Figure 3:
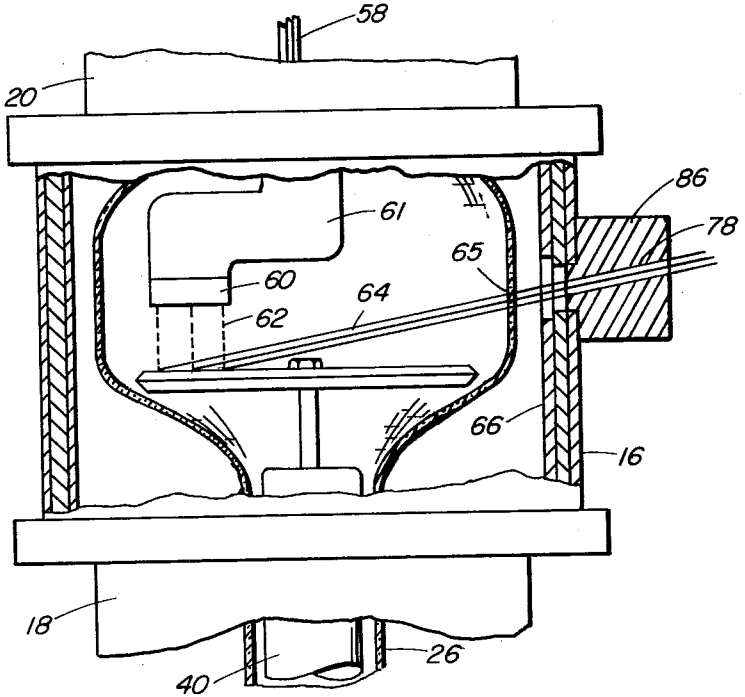
FIG. 3 is a fragmentary view partly in section of a modified X-ray tube embodying the invention.

Although the invention has been shown and described in connection with a cupped target as illustrated in FIGS. 1 and 2, it is to be understood that it may be used also with flat disc targets as shown in FIGS. 3 and 4. In FIG. 3 there is shown an external collimator 86 which is mounted over the window 72 and through which the useful X-ray beam 64 passes. The beam 64 emanates from a focal spot on the upper surface of a flat disc target 88 and traverses across the tube passing out through a wall area which is diametrically opposite the focal spot.

In FIG. 4 there is shown a flat disc target 88 which produces X-rays which pass as a useful beam 64 diametrically across the tube from the focal spot and eventually through a window 72 in the housing section 16. However, in this embodiment of the invention an internal collimator 90 is located within the area of radiation so as to collimate the useful beam 64 and shape it as desired.

Figure 5:
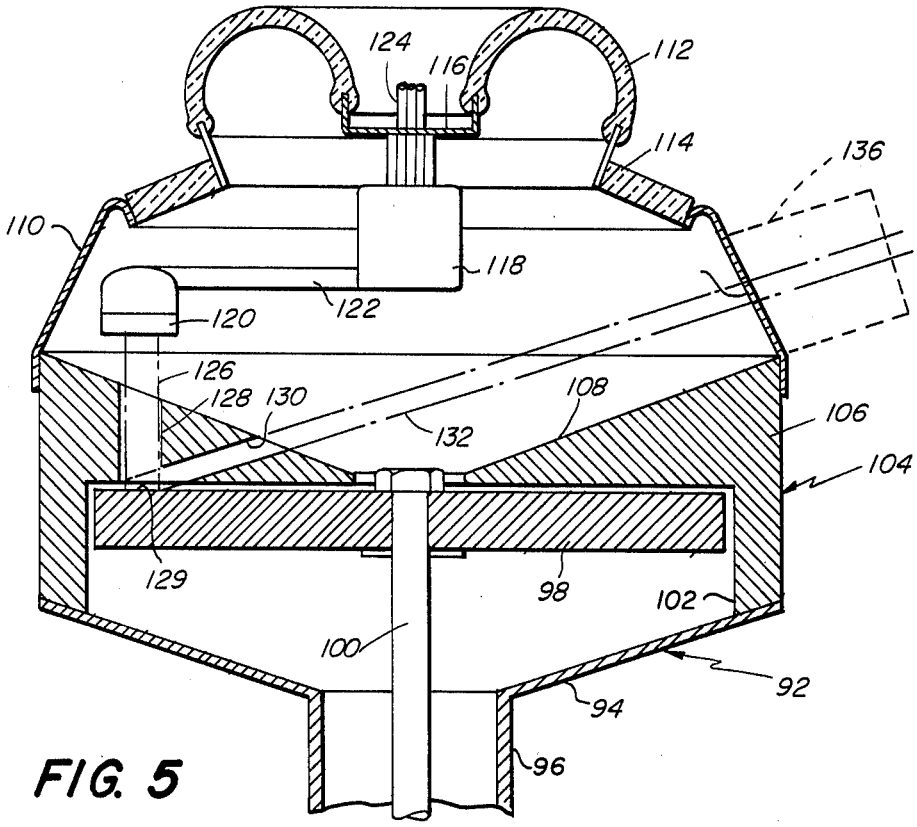
FIG. 5 is fragmentary axial sectional view of a still further modified X-ray tube embodying the invention.

In the tube structure of FIG. 5, the collimating means is of a modified form. The tube envelope 92 comprises a conical metal portion 94 having a neck 96 within which a rotor (not shown) may be positioned. A flat disc target 98 is mounted on the inner end of a shaft 100 and is encircled by a cylindrical skirt portion 102 of a cage 104. Cage 104 comprises an annular block or ring 106 which is preferably provided with a inwardly conical upper surface 108 and a relatively flat under surface which is disposed in relatively close-spaced relation to the upper surface of the target 98. The skirt portion 102 is preferably integral with and depends from the peripheral edge of the ring 106 and is slightly spaced from the edge of the target.

The cage 104 is sealed at the lower end of skirt 102 to the metal envelope portion 94 and itself forms a part of the envelope structure. A upper metal envelope portion or ring 110 is sealed at its lower end to the cage 104 as shown and at its upper end is sealed to a reentrant glass end portion 112 by a conventional metal dielectric seal 114. The metal portions of the envelope including the cage 104 are preferably maintained at anode potential by any suitable means.

An end cap or terminal 116 closes the reentrant end portion 112 of the envelope and has fixed to it a cathode support member 118. Member 118 supports a cathode 120 by means such as a laterally extending supporting arm 122. The cathode conventionally carries at least one filament (not shown) which is connected to suitable external filament potential by wires 124 in the known manner. When potential is applied to the cathode 120 electrons are emitted in the form of electron beam 126. The cage ring 104 is provided with a vertically extending slit 128 which extends through the block 106 from the inclined surface 108 to the surface adjacent the target. Thus, the electron beam 126 will pass through the slit 128 and will impinge upon a focal spot 129 on the target surface.

The ring 106 is also provided with a bore 130 one end of which is located on the lower surface at a point intersecting the slit 128 immediately above the focal spot 129. The bore 130 extends upwardly through the ring 106 at an angle such that an X-ray beam 132, which is generated at the focal spot 129 by the impingement thereon of the electron beam, will pass through the bore 130 in the direction of the envelope portion 110, as shown. Since the bore 130 is relatively long and cylindrical, the divergence of the X-ray beam 132 will be substantially reduced so that the beam will have a substantially nonspreading pencil shape, assuming the bore is cylindrical. If a fan-shaped beam is desired, the bore 130 may be shaped correspondingly.

The beam 130 thus will pass diametrically across the interior of the envelope from the focal spot 129 to wall 110 and will pass through the wall in a selected area known as the window 134. A second collimator 136, similar to collimator 76, may be mounted on wall 110 over the window 134 to provide additional collimation, if desired.

The cage 104 may be made of high atomic number material to provide a very near shutter for the X-ray beam, allowing substantially no off-axis radiation to escape or even to be generated on the target.

In any of the embodiments described herein the useful X-ray beam is collimated before it leaves the tube structure, either by a collimator located within the X-ray tube envelope or by a collimator located on the tube housing, or both, and the X-ray beam traverses a substantial distance within and diametrically of the tube either before or during collimation so that when it emerges from the final collimator it will have little tendency or opportunity to diverge. Thus, the tube is particularly suitable for use in systems such as computerized tomographic scanners.

It is to be understood however, that various changes and modifications in the structures shown and described may be made by those skilled in the art without departing from the spirit of the invention as expressed in the accompanying claims. Therefore, all matter is shown and described is to be interpreted as illustrative and not in a limiting sense.

What is claimed is:

1. A rotating anode X-ray tube for producing a pencil beam of X-rays comprising a housing, an X-ray tube located within the housing and having an envelope, an anode structure rotatably supported in one end of the envelope and including a target extending transversely of the envelope and mounted for rotation about a longitudinal axis, a cathode structure supported in the opposite end of the housing and disposed to emit electrons onto a focal spot on a surface of the target at one side of said axis, a window in said housing on the opposite side of said axis for transmitting from the tube X-rays which traverse diametrically of the tube along a path extending from the focal spot to the window, and collimating means separate from said anode structure and positioned within said envelope in the path of said X-rays for forming a pencil-like X-ray beam containing substantially parallel rays for suppressing substantially all divergence of the beam.

2. An X-ray tube structure as set forth in claim 1 wherein said collimating means is a tubular member of material opaque to X-rays, the internal cylindrical opening therethrough being aligned with said path.

3. An X-ray tube structure as set forth claim 1 wherein said collimating means overlies said target and has a cylindrical opening therethrough one end of which is directed toward the focal spot for passage of said pencil-like X-ray beam to the window.

4. An X-ray tube structure as set forth in claim 1 wherein said collimating means comprises a first collimator positioned in the path of said X-rays over said window and on the outer side of the housing, and a second collimator located within the envelope adjacent said target and in the path of said X-rays for forming said pencil-like beam.

5. An X-ray tube structure as set forth in claim 4 wherein said first collimator is a block of material opaque to X-rays and having a cylindrical bore therethrough aligned with said window, and said second collimator is a tubular member of material opaque to X-rays, the internal opening through said tubular member, the window, and the bore in said block being aligned with said path of the X-ray beam.

6. A rotating anode X-ray tube for producing a pencil beam of X-rays comprising an envelope, an anode structure rotatably supported in one end of the envelope for rotation about an axis and including a target extending transversely of the envelope and mounted with its center on said axis, a cathode structure supported in the opposite end of the envelope and disposed to emit electrons onto a focal spot on a surface of the target at one side of said axis for producing X-rays, said envelope having an X-ray transmitting window area in a side wall thereof at a location substantially diametrically opposite said focal spot whereby X-rays will traverse a path from the focal spot diametrically across the envelope to said window area, collimating means separate from said anode structure and positioned within the envelope in the path of said X-rays for forming a pencil-like X-ray beam containing substantially parallel rays and for suppressing substantially all divergence of the beam.

7. An X-ray tube as set forth in claim 6 wherein said collimating means is a tubular member of material opaque to X-rays, the internal cylindrical opening therethrough being aligned with said path.

8. An X-ray tube as set forth in claim 7 wherein said tubular member is supported on said cathode and is disposed in a position nearer to said focal spot than to said window area.

9. An X-ray tube as set forth in claim 6 wherein said collimating means overlies said target and focal spot and has a cylindrical opening therethrough one end of which is directed toward said focal spot for passage of said pencil-like X-ray beam to said window area.

10. An X-ray tube as set forth in claim 1 wherein said collimating means has a cylindrical passageway through which said pencil-like X-ray beam passes, which passageway is of a diameter not greater than the projected size of said focal spot.

11. An X-ray tube structure as set forth in claim 6 wherein said collimating means comprises a first collimator positioned in the path of said X-rays and over said window area and on the outer side of the envelope, and a second collimator located within the envelope adjacent said target, said collimators having aligned cyclindrical openings for passage of said pencil-like beam therethrough.

* * * * *